US011525368B2

(12) United States Patent
Pöhler et al.

(10) Patent No.: US 11,525,368 B2
(45) Date of Patent: Dec. 13, 2022

(54) TURBINE GUIDE APPARATUS

(71) Applicant: MAN Energy Solutions SE, Augsburg (DE)

(72) Inventors: Thorsten Pöhler, Dinslaken (DE); Dirk Frank, Voerde (DE); Jan Philipp Schnitzler, Düsseldorf (DE)

(73) Assignee: MAN ENERGY SOLUTIONS SE, Augsburg (DE)

( * ) Notice: Subject to any disclaimer, the term of this patent is extended or adjusted under 35 U.S.C. 154(b) by 0 days.

(21) Appl. No.: 17/340,314

(22) Filed: Jun. 7, 2021

(65) Prior Publication Data

US 2021/0381390 A1 Dec. 9, 2021

(30) Foreign Application Priority Data

Jun. 8, 2020 (DE) ..... 10 2020 115 106.3

(51) Int. Cl.
*F01D 11/22* (2006.01)
*F01D 9/04* (2006.01)

(52) U.S. Cl.
CPC ..... *F01D 11/22* (2013.01); *F01D 9/042* (2013.01); *F05D 2230/64* (2013.01); *F05D 2240/12* (2013.01)

(58) Field of Classification Search
CPC ..... F01D 11/22; F01D 9/042; F01D 25/246; F01D 9/041; F05D 2230/64; F05D 2240/12; F05D 2260/30
See application file for complete search history.

(56) References Cited

U.S. PATENT DOCUMENTS 4,017,213 A * 4/1977 Przirembel ..... F01D 5/187 415/115
4,720,236 A * 1/1988 Stevens ..... F01D 9/042 415/134
4,863,343 A * 9/1989 Smed ..... F01D 11/005 415/138

(Continued)

FOREIGN PATENT DOCUMENTS

DE 102016202519 8/2017
EP 3299584 3/2018

OTHER PUBLICATIONS

Search Report dated Aug. 30, 2021 issued in European Patent Application No. 21177397.

*Primary Examiner* — Woody A Lee, Jr.
*Assistant Examiner* — Eric A Lange
(74) *Attorney, Agent, or Firm* — Cozen O'Connor

(57) ABSTRACT

A turbine guide apparatus, having multiple guide blades. Each guide blade has a first shroud and a second shroud formed on radial ends of a blade leaf having a first carrier for the guide blades. Each guide blade is fastened to the first carrier via a first shroud projection having a second carrier for the guide blades and is fastened on the second carrier via a second shroud projection. The first shroud projection is inserted into a groove of the first carrier in the radial direction and fastened in this groove via a bolt extending in the axial direction through the projection of the first shroud with radial mobility in this groove. The second shroud projection of the guide blade is fastened in the circumferential and radial direction via a pin extending in the axial direction into the projection of the second shroud and the second carrier.

15 Claims, 4 Drawing Sheets

(56) References Cited

U.S. PATENT DOCUMENTS

| | | | | |
|---|---|---|---|---|
| 5,839,878 | A * | 11/1998 | Maier | F01D 9/042 415/209.2 |
| 7,926,289 | B2 | 4/2011 | Lee et al. | |
| 7,958,735 | B2 * | 6/2011 | Ellis | F01D 25/246 415/191 |
| 8,070,431 | B2 * | 12/2011 | Harter | F01D 9/042 415/213.1 |
| 8,356,975 | B2 | 1/2013 | Grover et al. | |
| 8,356,981 | B2 | 1/2013 | Cooke et al. | |
| 2006/0032236 | A1 | 2/2006 | Aumont et al. | |
| 2006/0062673 | A1 | 3/2006 | Coign et al. | |
| 2017/0241279 | A1 * | 8/2017 | Schlemmer | F01D 25/243 |

* cited by examiner

TURBINE GUIDE APPARATUS

BACKGROUND OF INVENTION

1. Field of the Invention

The disclosure relates to a turbine guide apparatus.

2. Description of Related Art

Gas turbines comprise turbine guide apparatuses. A turbine guide apparatus is a stator-side assembly comprising multiple guide blades or guide blade segments each of multiple guide blades and carriers for fastening or bracing the guide blades or guide blade segments. These carriers for fastening or bracing the guide blades are also referred to as guide blade carriers or guide blade segment carriers. The respective guide blades typically comprise shrouds, namely a first shroud and a second shroud, which are formed at radial ends of a blade leaf of the guide blades located opposite one another. A radially inner shroud is also referred to as inner shroud and a radially outer shroud also as outer shroud. The guide blades or guide blade segments are fastened to or braced on the carriers at their radial ends, namely via their shrouds, wherein each guide blade or each guide blade segment is fastened to or braced on a first carrier in the region of the first shroud and on a second carrier in the region of the second shroud.

U.S. Pat. No. 8,356,981 B2 discloses a gas turbine with a turbine guide apparatus. The turbine guide apparatus comprises multiple guide blades, wherein each guide blade radially inside comprises an inner shroud and radially outside an outer shroud. On the inner shroud a projection is formed that engages in a groove on the inner carrier for the guide blades. On the outer shroud, a projection is likewise formed that engages in a groove of the outer carrier for the guide blades. On this projection of the outer shroud, a crowned contour is formed, with which the projection braces itself on an axial surface of the groove of the outer carrier.

Further gas turbines with guide blade carriers are known from U.S. Pat. No. 8,356,975 B2 and from U.S. Pat. No. 7,926,289 B2.

SUMMARY OF THE INVENTION

There is a need for improving on a turbine guide apparatus the fastening or bracing of the guide blades or guide blade segments on the carriers of the turbine guide apparatus and preferentially also sealing the guide blades or guide blade segments on the carriers of the turbine guide apparatus. Starting out from this, the present disclosure is a new type of turbine guide apparatus.

According to one aspect of the invention, the projection of the first shroud of the respective guide blade or of the respective guide blade segment is inserted into a groove of the first carrier in the radial direction and fastened and braced in this groove via a bolt extending in the axial direction through the projection of the first shroud with radial mobility in this groove in the circumferential direction. The projection of the second shroud of the respective guide blade or of the respective guide blade segment is fastened and braced in the circumferential direction and radial direction via a pin extending in the axial direction into the projection of the second shroud and the second carrier. This allows a particularly advantageous fastening and bracing and thus suspension of the guide blades or guide blade segments on the carriers of the turbine guide apparatus.

Thermo-mechanical deformations of the carriers of the turbine guide apparatus do not result in an additional load on the guide blades or guide blade segments. Forces acting on the guide blades or guide blade segments during the operation can be optimally discharged to the carriers.

Preferentially, the respective bolt extends in the axial direction through a slot of the projection of the first shroud that is open in the radial direction and through the first carrier. By way of this, the radial mobility of the respective guide blade or of the respective guide blade segment relative to the first carrier can be ensured in a particularly simple manner.

Preferentially, the respective pin has a cylindrically contoured outer wall on a section of the same, which extends in the axial direction into the second carrier, wherein the respective pin on a section of the same, which extends in the axial direction into the second shroud of the respective guide blade or of the respective guide blade segment, comprises an outer wall contoured torus-like or ball head-like. By way of this it can be easily ensured that the respective guide blade or the respective guide blade segment, as a consequence of a thermo-mechanical deformation, can tilt relative to the second shroud.

Preferentially, the projection of the first shroud of the respective guide blade or of the respective guide blade segment is braced via an axial surface section of crowned contour on an axial surface of the groove of the first carrier and/or the projection of the second shroud of the respective guide blade or of the respective guide blade segment via an axial surface section of crowned contour on an axial surface of the second carrier. The respective axial surface section of the respective guide blade or of the respective guide blade segment of crowned contour preferentially runs, seen in the circumferential direction, linearly at least in sections. The respective axial surface section of crowned contour is particularly preferred for a sealing of the respective shroud of the respective guide blade or of the respective guide blade segment relative to the respective carrier. Even in particular when for example as a consequence of a thermo-mechanical deformation the respective guide blade or the respective guide blade segment should tilt relative to the respective carrier, a tightness between the respective shroud and the respective carrier can be ensured. Leakages via the shrouds can thus be avoided.

Preferentially, a slot is introduced into the respective axial surface section of the respective guide blade or of the respective guide blade segment of crowned contour at a circumferential end, which slot together with a corresponding slot of a guide blade following in the circumferential direction or of a guide blade segment following in the circumferential direction bounds a groove which receives a sealing plate. By way of this, the tightness of the suspension of the guide blades or guide blade segments on the respective carrier can be further improved.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

DETAILED DESCRIPTION OF THE PRESENTLY PREFERRED EMBODIMENTS

The disclosure relates to a turbine guide apparatus 10, in particular of a gas turbine. Such a turbine guide apparatus 10 comprises multiple guide blades 11 or multiple guide blade segments of multiple guide blades 11.

Figure 1:
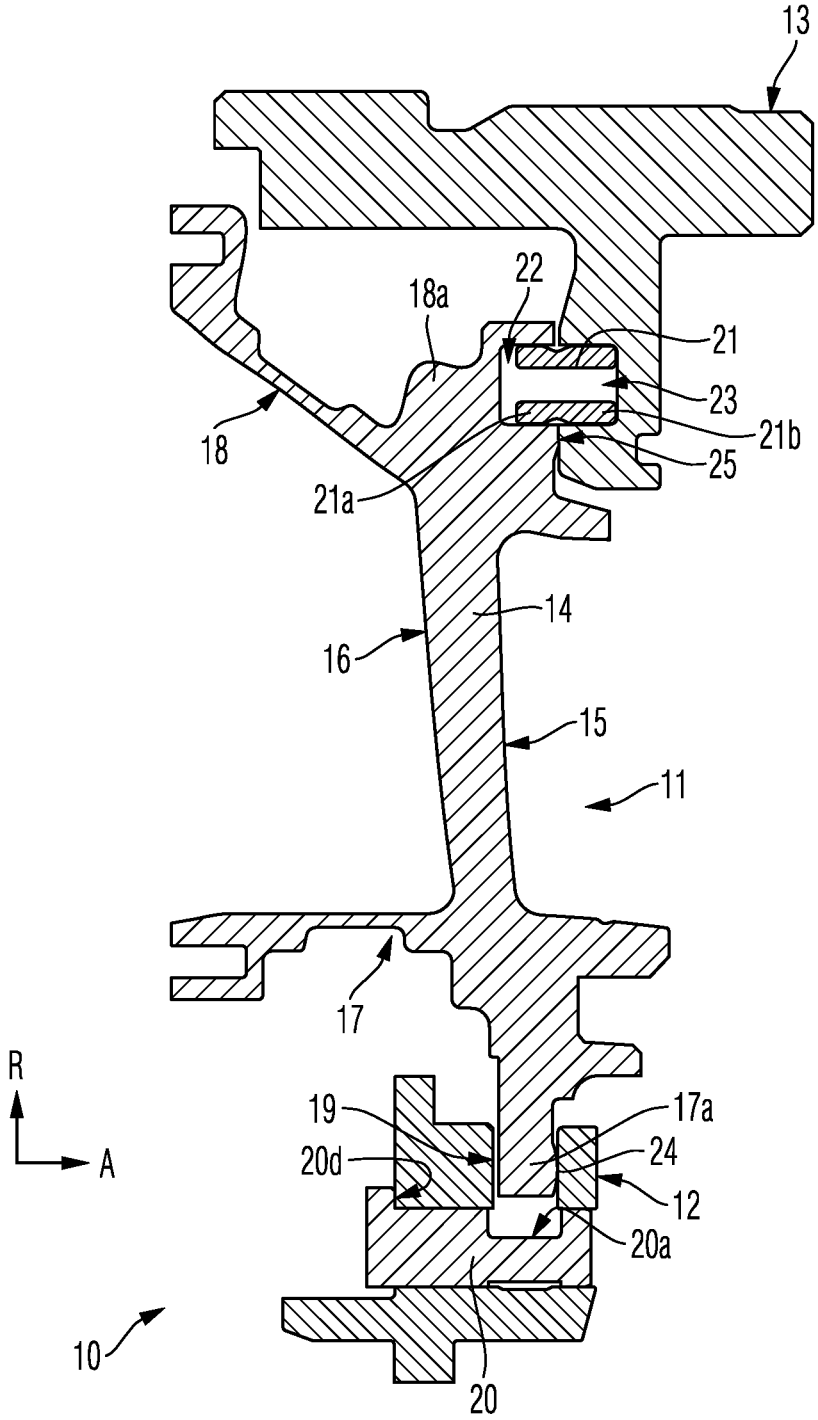
FIG. 1 is a cross section through a turbine guide apparatus.

FIG. 1 shows a cross section through a turbine guide apparatus 10 in the region of such a guide blade 11, in the region of a first carrier 12 and in the region of a second carrier 13 for the guide blades 11. The carriers 12, 13 are also referred to as guide blade carriers.

Each guide blade 11 of the turbine guide apparatus 10 comprises a blade leaf 14 with flow-guiding surfaces 15, 16. On the guide blade 11, shrouds are formed on ends of the blade leaf 14 located radially opposite one another, namely a first shroud 17 and a second shroud 18.

The respective guide blade 11 is fastened to and braced on the first carrier 12 via its first shroud 17. Furthermore, each guide blade 11 is fastened to and braced on the second carrier 13 via its second shroud 18.

In the exemplary embodiment shown in FIG. 1, the first shroud 17 is a shroud located radially inside, in the following referred to as inner shroud, of the guide blade 11 and the first carrier 12, a carrier located inside to/on which the guide blade 11 is fastened and braced. The second shroud 18 in FIG. 1 is a shroud located radially outside, in the following referred to as outer shroud, and the second carrier 13 a radially outer carrier, to/on which the guide blade 11 is fastened and braced.

On the first shroud 17, in FIG. 1 on the inner shroud, the respective guide blade 11 comprises a projection 17*a*, which in the radial direction R is inserted into a groove 19 of the first carrier 12 and is fastened to and braced in this groove 19 of the first carrier 12 via a bolt 20 extending in the axial direction A through the projection 17*a* and through the carrier 12 with radial translational mobility within this groove 19 in the circumferential direction U.

On the second shroud 18 located opposite, i.e. in the shown exemplary embodiment on the outer shroud 18, a projection 18*a* is formed via which the respective guide blade 11 is fastened to and braced on the second carrier 13, such that pin 21 extending in the axial direction A extends on the one hand into the projection 18*a* of the second shroud 18 and on the other hand into the second carrier 13 and fastens and braces the guide blade 11 to/on the second carrier 13 in the circumferential direction U and radial direction R.

Accordingly, the respective guide blade 11 in the region of the second carrier 13 is fastened and supported in the circumferential direction U and radial direction R via its second shroud 18 and via the respective pin 21, so that a translational movement of the guide blade 11 in the circumferential direction U and radial direction R relative to the second carrier 13 is prevented.

In the region of the first shroud 17, the guide blade 11 is fastened and braced in the circumferential direction U via the projection 17*a* of the first shroud 17, namely via the bolt 20, which in the axial direction A extends through the first carrier 12 and the projection 17*a* of the first shroud 17 of the respective guide blade 11. Accordingly, the respective guide blade 11 is fixed in the circumferential direction U in the region of the first shroud 17, but not in the radial direction R, so that a radial translational mobility of the guide blade 11 relative to the first carrier 12 is possible.

As already explained, the pin 21, which serves for fastening and supporting the respective guide blade 11 on the second shroud 13 in the circumferential direction U and radial direction R, extends in the axial direction A, wherein this pin 21 on the one hand engages in the axial direction A into a recess 22 in the projection 18*a* of the second shroud 18 of the respective guide blade 11 and on the other hand into a recess 23 of the second carrier 13.

Figure 6:
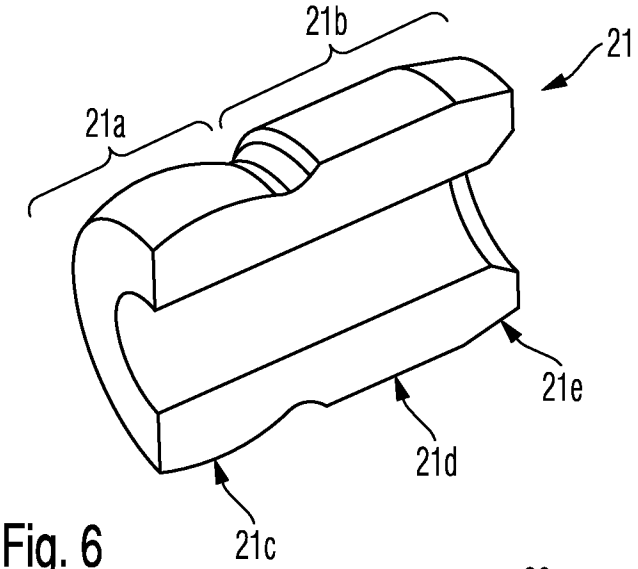
FIG. 6 is a cross section through FIG. 5.
Figure 5:
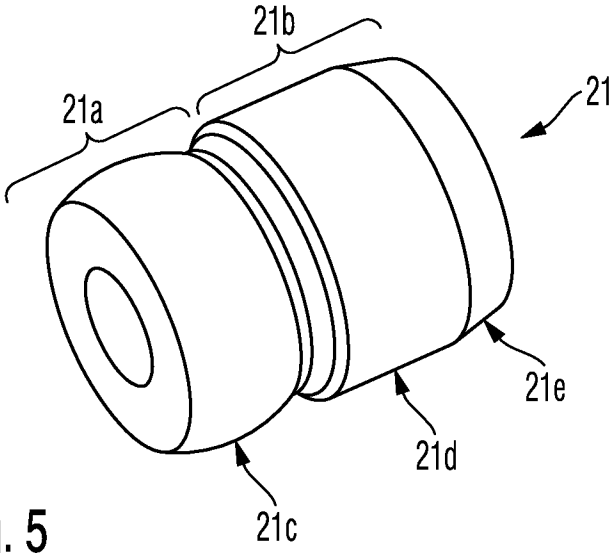
FIG. 5 is a perspective view of a pin.

FIGS. 5 and 6 show detail views of the pin 21. The pin 21 comprises a section 21*a* that extends into the recess 22 of the projection 18*a* of the second shroud 18 of the respective guide blade 11, wherein the pin 21 on this section 21*a* has an outer wall 21*c* contoured torus-like or ball head-like.

Seen in the axial direction A next to this section 21*a* with the outer wall 21*c* contoured torus-like or ball head-like, a section 21*b* of the pin 21 follows that extends into the recess 23 in the second carrier 13 of the guide apparatus 10, wherein this section 21*b* of the pin 21 has a cylindrically contoured outer wall 21*d*.

At an end of the section 21*b* facing away from the section 21*a*, the section 21*b* has a conically tapering outer wall 21*e* in order to be able to more easily introduce the pin 21 into the recess 23 of the second carrier 13.

The section 21*a* of the pin 21, which projects into the recess 22 of the projection 18*a* of the second shroud 18 and the outer wall 21*c* contoured torus-like or ball head-like, permits a tilting of the respective guide blade 21 relative to the second carrier 13, in particular a tilting about an axis extending in the radial direction R or a tilting about an axis extending in the circumferential direction U or tangentially to the circumferential direction U.

Figure 8:
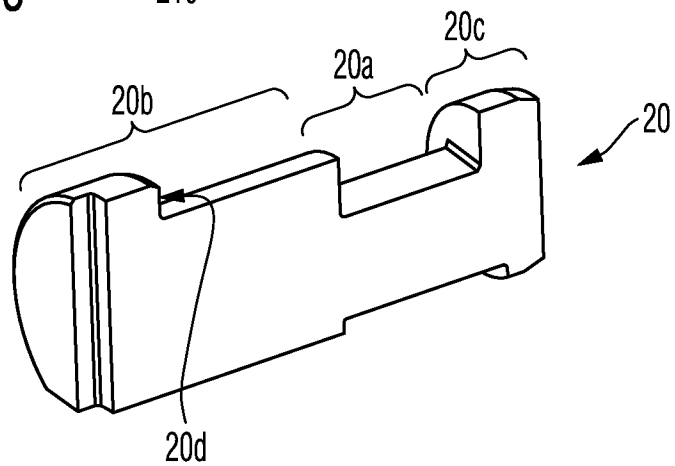
FIG. 8 is a cross section through FIG. 7.
Figure 7:
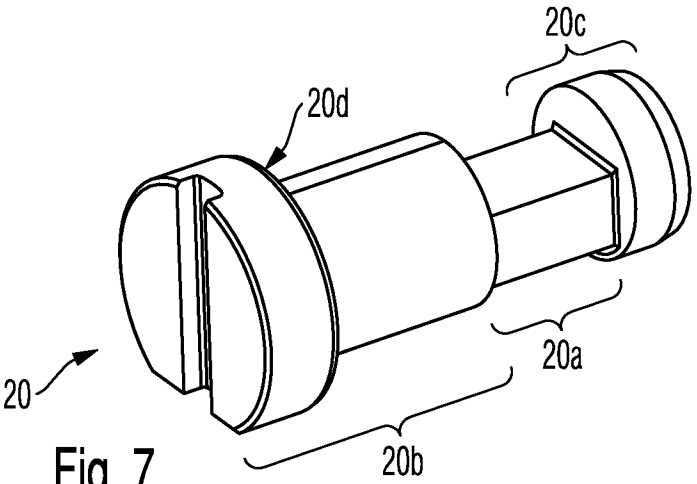
FIG. 7 is a perspective view of a bolt.

As explained, the guide blade 11 in the shown exemplary embodiment is fastened to the first carrier 12 on its first shroud 17 in that the projection 17*a* of the first shroud 17 projects in the radial direction R into the groove 19 of the first carrier 12 where it is fastened and supported in the circumferential direction U via a bolt 20, which seen in the axial direction A extends through the first carrier 12 and the projection 17*a* of the first shroud 17. FIGS. 7 and 8 show detail views of such a bolt 20. In the assembled state, a middle section 20*a* of the bolt 20 interacts with the projection 17*a* projecting into the groove 19 of the first carrier 12 in such a manner that relative to the first carrier 12 there is the radial translational mobility of the guide blade 11 in the groove 19. For this purpose, the bolt 20 extends in the axial direction A through a slot 29 of the projection 17*a* that is open in the radial direction R, wherein the bolt 20 in the section 20*a* is dimensioned so that the radial translational mobility of the guide blade 11 relative to the first carrier 12 is possible both radially to the inside and also radially to the outside. This middle section 20*a* of the bolt 20 is followed on both sides by lateral sections 20*b* and 20*c*, via which the bolt is fixed in a recess in the first carrier 12. A shoulder 20*d* formed on the section 20*b* limits the introduction depth of the respective bolt 20 into the first carrier 12 and ensures an exact relative positioning between the section 20*a* of the respective bolt 20 and the projection 17*a* on the first shroud 17 of the respective guide blade 11. The groove 29 in the projection 17*a* of the first shroud 17 fixes the axial position of the bolt 20 via flanks of the section 20*a* of the bolt 20.

As already explained above, the respective guide blade 11 can translationally reposition itself relative to the first carrier 12 in the radial direction R, in particular as a consequence of thermo-mechanical deformations. In the region of the second shroud 18 however a translational repositioning in the radial direction R is excluded through the fastening of the respective shroud 11 to the second carrier 13 via the pin 21 described above, likewise a translational repositioning in the circumferential direction U. Because of the fact that the pin 21 however has the outer wall 21*c* that is contoured torus-like or ball head-like on the section 21, a tilting of the respective guide blade 11 relative to the second carrier 13 and thus also first carrier 12 is possible.

In order to make possible a tight connection of the respective guide blade 11 via the respective shroud 17, 18 on the respective carrier 12, 13 despite this tilting movement of the respective guide blade 11 relative to the carrier 12, 13, the projection 17*a* of the first shroud 17 and the projection 18*a* of the second shroud 18 comprises an axial surface section 24, 25 of crowned contour in the shown exemplary embodiment. The crowned axial surface section 24 of the projection 17*a* of the first shroud 12 comes to lie against and is supported on an axial surface of the groove 19 of the first carrier 12 and the crowned axial surface section 25 of the projection 18*a* of the second shroud 18 on an axial surface of the second carrier 13.

When the guide blade 11 tilts relative to the carriers 12, 13 in particular as a consequence of thermo-mechanical deformations, these crowned axial surface sections 24, 25 roll on the adjoining axial surface of the groove 19 of the first carrier 12 or the adjoining axial surface of the second carrier 13 and thus ensure a tight suspension of the respective guide blade 11 in the region of their respective shroud 17, 18 on the respective carrier 12, 13.

Figures 2, 3, 4:
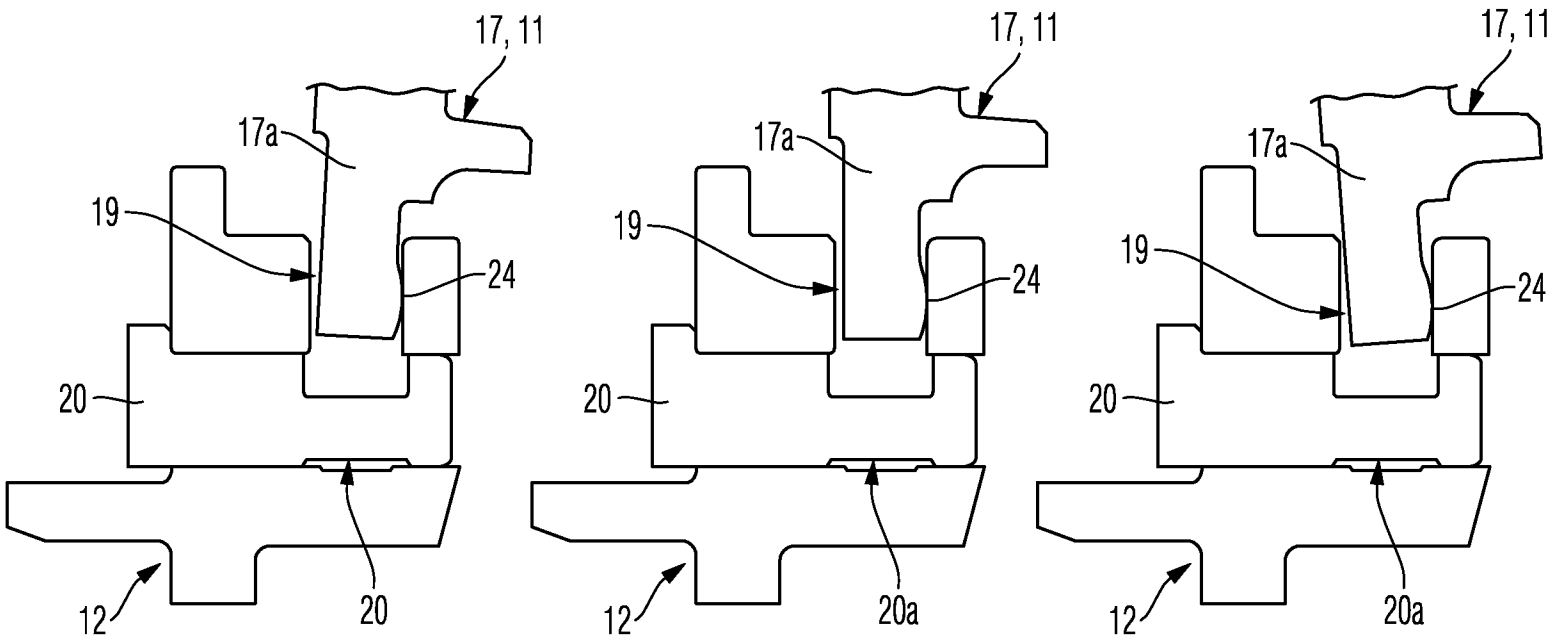
FIG. 2 is a detail of FIG. 1 in a first state.
FIG. 3 is the detail of FIG. 2 in a second state.
FIG. 4 is the detail of FIG. 2 in a third state.

FIGS. 2 and 3 show this rolling movement for the projection 17*a* on the first shroud 17 relative to the first carrier 12. In FIG. 3, the guide blade 11 is untilted. In FIGS. 2 and 4, the guide blade 11 is tilted in each case namely in different directions, namely in FIG. 2 in clockwise direction and in FIG. 4 in anticlockwise direction.

In order to make possible this tilting movement of the guide blade 11 there is an axial clearance between the projection 17*a* of the first shroud 17 of the guide blade 11 and the groove 19 of the first carrier 12 seen in the axial direction A. On the projection 18*a* of the second shroud 18 of the guide blade 11, the pin 21, namely the section 21*a* of the same with the torus-shaped or ball head-shaped outer wall 21*c* allows an axial relative movement between guide blade 11 and second carrier 13.

Figure 9:
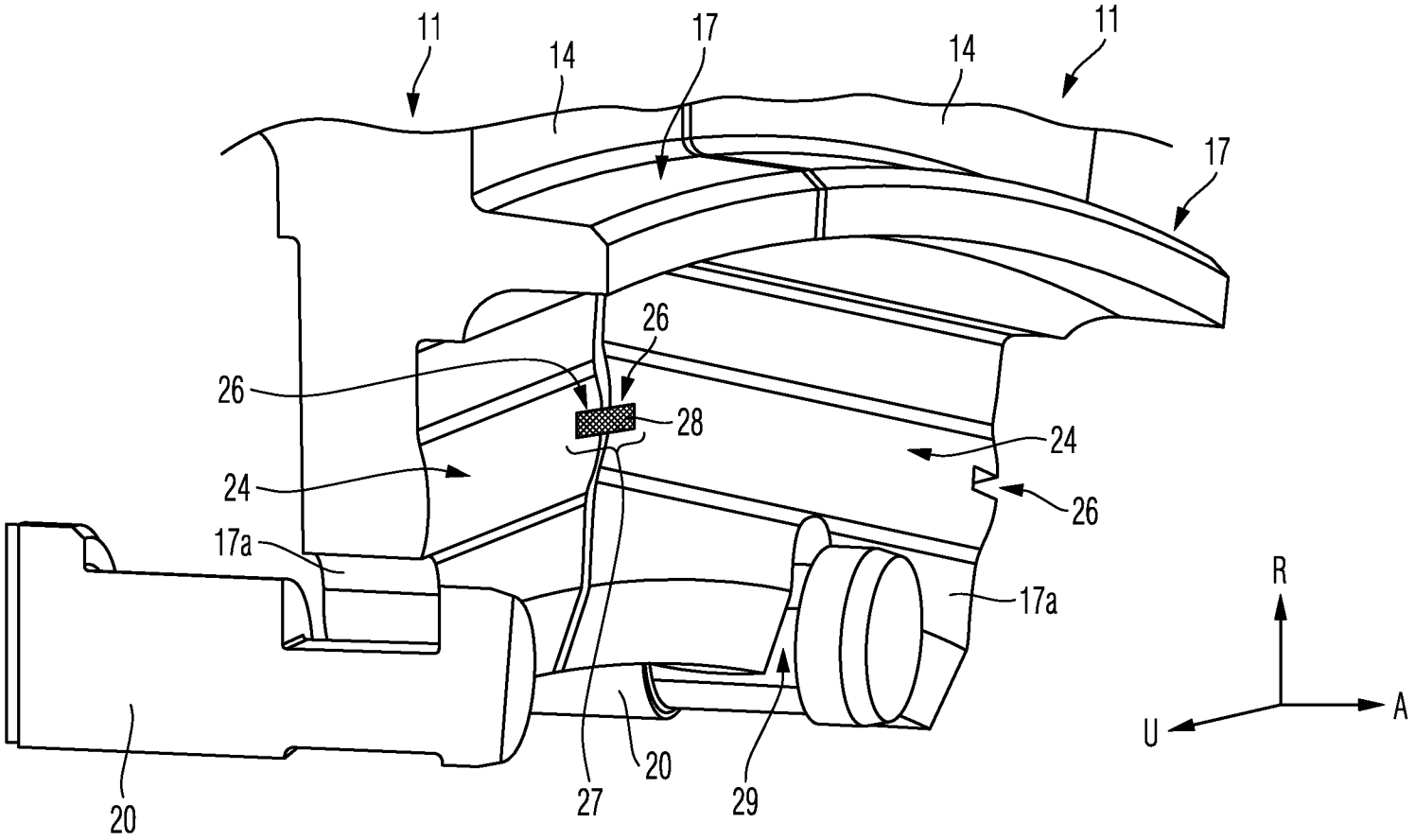
FIG. 9 is a perspective view of a cross section by way of an extract through a turbine guide apparatus.

As is shown in FIG. 9 for the crowned axial surface section 24 of the projection 17*a* of the first shroud 17 of the guide blade 11, the respective crowned axial surface section 24 extends linearly, at least in sections, namely in FIG. 9 linearly throughout over the respective section 17*a* and thus tangentially to the circumferential direction U. The crowned axial surface sections 24 of adjacent guide blades 11 form a polygonal chain.

From FIG. 9 it is evident that a slot 26 each is introduced into the crowned axial surface section 24 of the projection 17*a* of the first shroud 17 of the respective guide blade in the region of each circumferential end of the respective projection 17*a*. Adjoining slots 26 of guide blades 11 that are adjacent seen in the circumferential direction U define a groove 27, which receives a sealing plate 28. Seen in the axial direction A, this sealing plate 28 terminates flush with the respective crowned axial surface section 24. By way of this, the tightness of the suspension or fastening of the guide blades 11 can be further improved.

Such slots 26 for forming the grooves 27 that serve for receiving a sealing plate 28 are preferentially formed not only in the crowned axial surface sections 24 on the section 17*a* of the first shroud 17 but preferentially also on the crowned axial surface section 25 of the projection 18*a* of the second shroud 18 of the respective guide blade 11.

The turbine guide apparatus 10 according to one aspect of the invention is characterized by a completely new type of fastening, bracing and sealing of guide blades 11 on the carriers 12, 13 of the turbine guide apparatus 10. Thermo-mechanical deformations, in particular in the region of the carriers 12, 13, do not result in an additional blade loading. To a certain extent, a translational relative movement and a tilting of the respective guide blade 11 relative to the carriers 12, 13 is possible. Despite these relative movements however a tightness of the suspension of the respective guide blade on the respective carrier 12, 13 is ensured. Forces acting on the guide blades 11 can be discharged via both shrouds 17, 18 to both carriers 12, 13.

It is pointed out that the details described above, based on the shrouds 17, 18 and carriers 12, 13, can also be switched. Thus, the suspension of the respective guide blade 11 via the respective bolt 20 on the outer shroud 18 and second carrier 13 described above and the suspension of the respective guide blade 11 on the inner shroud 17 and first carrier 12 via the respective pin 21 described above can be utilised.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A turbine guide apparatus, comprising:

multiple guide blades or multiple guide blade segments, wherein each guide blade or each guide blade segment comprises:

a first shroud having a first projection; and a second shroud having a second projection;

wherein the first shroud and the second shroud are formed on opposite radial ends of a blade leaf of a respective guide blade or of a respective guide blade segment;

a first carrier for the guide blades or the guide blade segments, wherein each guide blade or each guide blade segment is fastened to or braced on the first carrier via the first projection of the respective first shroud;

a second carrier for the guide blades or the guide blade segments, wherein each guide blade or each guide blade segment is fastened to or braced on the second carrier via the second projection of the respective second shroud;

a groove of the first carrier;

a bolt; and a pin;

wherein the first projection of the first shroud of the respective guide blade or of the respective guide blade segment is inserted into the groove of the first carrier in a radial direction and is fastened and braced with radial mobility in this groove in a circumferential direction via the bolt extending in an axial direction through the first projection of the first shroud, and wherein the second projection of the second shroud of the respective guide blade or of the respective guide blade segment is fastened and braced in the circumferential direction and radial direction via the pin extending in the axial direction into the second projection of the second shroud and the second carrier, wherein the bolt comprises:

a first lateral section having a circular head, a shoulder, and a cylindrical body that extends longitudinally from the shoulder and having a first axis;

a second lateral section having a circular cross section having a second axis that is aligned with the first axis; and a middle section having a noncircular cross section and arranged between the first lateral section and the second lateral section, wherein an axial center of the middle section is offset from the first axis and the second axis.

2. The turbine guide apparatus according to claim 1, wherein:

the first shroud of the respective guide blade or of the respective guide blade segment is an outer shroud, the second shroud of the respective guide blade or of the respective guide blade segment is an inner shroud, the first carrier is a radially outer carrier, and the second carrier is a radially inner carrier.

3. The turbine guide apparatus according to claim 1, wherein the bolt extends in the axial direction through a slot that is open in the radial direction of the first projection of the first shroud and through the first carrier.

4. The turbine guide apparatus according to claim 1, wherein:

the pin, on a first section of the pin, which extends in the axial direction into the second carrier, has a cylinder-shaped outer wall, and the pin, on a second section of the pin, which extends in the axial direction into the second projection of the second shroud of the respective guide blade or of the respective guide blade segment, has a torus-shaped or ball head-shaped outer wall.

5. The turbine guide apparatus according to claim 1, wherein the first projection of the first shroud of the guide blade or of the guide blade segment is braced via a crowned axial surface section against an axial surface of the groove of the first carrier, wherein seen in the axial direction there is an axial clearance between the first projection of the first shroud of the respective guide blade or of the respective guide blade segment and the groove of the first carrier.

6. The turbine guide apparatus according to claim 5, wherein the respective crowned axial surface section runs, seen in the circumferential direction, linearly at least in sections.

7. The turbine guide apparatus according to claim 5, wherein a slot is introduced into the respective crowned axial surface section at a circumferential end, which together with a corresponding slot of a guide blade following in the circumferential direction or of a guide blade segment following in the circumferential direction bounds a groove, which receives a sealing blade.

8. The turbine guide apparatus according to claim 7, wherein the sealing blade terminates flush with the respective crowned axial surface section in the axial direction.

9. The turbine guide apparatus according to claim 1, wherein the second projection of the second shroud of the respective guide blade or of the respective guide blade segment is braced via a crowned axial surface section on an axial surface of the second carrier.

10. The turbine guide apparatus according to claim 9, wherein the respective crowned axial surface section runs, seen in the circumferential direction, linearly at least in sections.

11. The turbine guide apparatus according to claim 10, wherein a slot is introduced into the respective crowned axial surface section at a circumferential end, which together with a corresponding slot of a guide blade following in the circumferential direction or of a guide blade segment following in the circumferential direction bounds a groove, which receives a sealing blade.

12. The turbine guide apparatus according to claim 1, wherein an axis of the cylindrical body is offset from the axis of the circular head.

13. The turbine guide apparatus according to claim 2, wherein an axis of the second lateral section is in line with the axis of the cylindrical body.

14. A turbine guide apparatus, comprising:

multiple guide blades or multiple guide blade segments, wherein each guide blade or each guide blade segment comprises:

a first shroud having a first projection; and a second shroud having a second projection;

wherein the first shroud and the second shroud are formed on opposite radial ends of a blade leaf of a respective guide blade or of a respective guide blade segment;

a first carrier for the guide blades or the guide blade segments, wherein each guide blade or each guide blade segment is fastened to or braced on the first carrier via the first projection of the respective first shroud;

a second carrier for the guide blades or the guide blade segments, wherein each guide blade or each guide blade segment is fastened to or braced on the second carrier via the second projection of the respective second shroud;

a groove of the first carrier;

a bolt; and a pin;

wherein the first projection of the first shroud of the respective guide blade or of the respective guide blade segment is inserted into the groove of the first carrier in a radial direction and is fastened and braced with radial mobility in this groove in a circumferential direction via the bolt extending in an axial direction through the first projection of the first shroud, and wherein the second projection of the second shroud of the respective guide blade or of the respective guide blade segment is fastened and braced in the circumferential direction and radial direction via the pin extending in the axial direction into the second projection of the second shroud and the second carrier, wherein the bolt comprises:

a first lateral section having a circular head with an axis, a shoulder, and a cylindrical body;

a second lateral section having a circular cross section; and a middle section having a noncircular cross section and arranged between the first lateral section and the second lateral section, wherein an axial center of the middle section is offset from the axis, wherein:

the first shroud of the respective guide blade or of the respective guide blade segment is an inner shroud, the second shroud of the respective guide blade or of the respective guide blade segment is an outer shroud, the first carrier is a radially inner carrier, and the second carrier a radially outer carrier.

15. A turbine guide apparatus, comprising:

multiple guide blades or multiple guide blade segments, wherein each guide blade or each guide blade segment comprises:

a first shroud having a first projection; and a second shroud having a second projection;

wherein the first shroud and the second shroud are formed on opposite radial ends of a blade leaf of a respective guide blade or of a respective guide blade segment;

a first carrier for the guide blades or the guide blade segments, wherein each guide blade or each guide blade segment is fastened to or braced on the first carrier via the first projection of the respective first shroud;

a second carrier for the guide blades or the guide blade segments, wherein each guide blade or each guide blade segment is fastened to or braced on the second carrier via the second projection of the respective second shroud;

a groove of the first carrier;

a bolt; and a pin;

wherein the first projection of the first shroud of the respective guide blade or of the respective guide blade segment is inserted into the groove of the first carrier in a radial direction and is fastened and braced with radial mobility in this groove in a circumferential direction via the bolt extending in an axial direction through the first projection of the first shroud, and wherein the second projection of the second shroud of the respective guide blade or of the respective guide blade segment is fastened and braced in the circumferential direction and radial direction via the pin extending in the axial direction into the second projection of the second shroud and the second carrier, wherein the bolt comprises:

a first lateral section having a circular head with an axis, a shoulder, and a cylindrical body;

a second lateral section having a circular cross section; and a middle section having a noncircular cross section and arranged between the first lateral section and the second lateral section, wherein an axial center of the middle section is offset from the axis, wherein the noncircular cross section is rectangular.

* * * * *